United States Patent [19]

Wallace

[11] 4,203,241

[45] May 20, 1980

[54] ACTION SIGN

[76] Inventor: Charles W. Wallace, Rte. #10, Marion, Ky. 42064

[21] Appl. No.: 821,141

[22] Filed: Aug. 2, 1977

[51] Int. Cl.[2] ..... G09F 19/00; G09F 13/44

[52] U.S. Cl. ..... 40/406; 40/427; 272/8 F

[58] Field of Search ..... 40/406, 407, 427, 538, 40/428, 540; 126/41 R; 431/1; 35/55, 49; 426/104; 428/13, 15, 21; 46/9; 272/8 F, 15

[56] References Cited

U.S. PATENT DOCUMENTS

| | | | |
|---|---|---|---|
| 661,426 | 11/1900 | Sherwood | 272/15 |
| 1,030,035 | 6/1912 | Tully | 272/15 |
| 1,157,422 | 10/1915 | Rustige | 431/1 |
| 1,458,526 | 6/1923 | Elorza | 40/406 |
| 1,641,468 | 9/1927 | Arns | 40/540 |
| 2,498,406 | 2/1950 | Fay | 35/55 |
| 2,513,290 | 1/1946 | Paly | 35/49 |
| 2,956,359 | 10/1960 | Smith et al. | 40/442 |
| 3,395,475 | 8/1968 | Moss | 40/428 |
| 3,444,637 | 5/1969 | Joy | 40/428 |
| 3,723,046 | 3/1973 | Poling et al. | 272/15 |
| 3,757,801 | 9/1973 | Breslow et al. | 40/407 X |
| 3,964,194 | 6/1976 | Gugelar | 40/406 |
| 4,092,975 | 6/1978 | Grammatopoulos | 126/41 R |

FOREIGN PATENT DOCUMENTS

| | | | |
|---|---|---|---|
| 454300 | 12/1927 | Fed. Rep. of Germany | 46/37 |
| 360,899 | 3/1906 | France | 40/407 |
| 338835 | 10/1930 | United Kingdom | 46/9 |
| 484537 | 5/1938 | United Kingdom | 46/9 |

*Primary Examiner*—Richard C. Pinkham
*Assistant Examiner*—Scott L. Brown
*Attorney, Agent, or Firm*—Lowe, King, Price & Becker

[57] ABSTRACT

Disclosed is a three dimensional action sign comprising at least one three dimensional simulated object and at least two independent ways for producing separate actions in the sign. Preferably the object is of a simulated piece of meat disposed on a cooking grill, a simulated charcoal fire and the separate actions include the causing of a flame to rise from the simulated piece of meat and smoke to rise from the simulated charcoal fire.

9 Claims, 4 Drawing Figures

ACTION SIGN

BACKGROUND OF THE INVENTION

This invention relates to advertising signs. It is particularly adapted for advertising steak houses, hamburger restaurants, and the like.

Signs with eye catching "action" elements are well known. In general such signs include only a single action element, such as a moving arm pointing in the direction of a restaurant, the odor emitters in the sign disclosed in U.S. Pat. No. 1,204,934 to Burford et al., or the like. Such signs are a marked improvement over passive signs (that is, ordinary signs in which all parts simply remain fixed), but they are limited in "eye catching" ability by the fact that they employ only a single action.

Similarly, three dimensional signs incorporating a three dimensional tableau or graphic representation of some scene or object are known. However, such signs have not, so far as I know, incorporated action elements, nor have the action signs been three dimensional (except to the extend that one planar, moving element may be placed in front of another, stationary background element).

SUMMARY OF THE INVENTION

My invention combines and improves on the state of the art in both action signs and three dimensional signs. Broadly stated, it is a three dimensional action sign comprising a three dimensional tableau and at least two independent means for producing separate actions in the sign. In the presently preferred embodiment, the tableau is of a piece of meat disposed on a grill over a simulated charcoal fire, and the action elements include means for causing a flame to rise from the piece of meat and means for causing smoke to rise from the charcoal fire.

CAVAT

The advantages of the present invention will become apparent to those skilled in the art from the following detailed description, wherein I have described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PRESENTLY PREFERRED EMBODIMENTS

Figure 1:
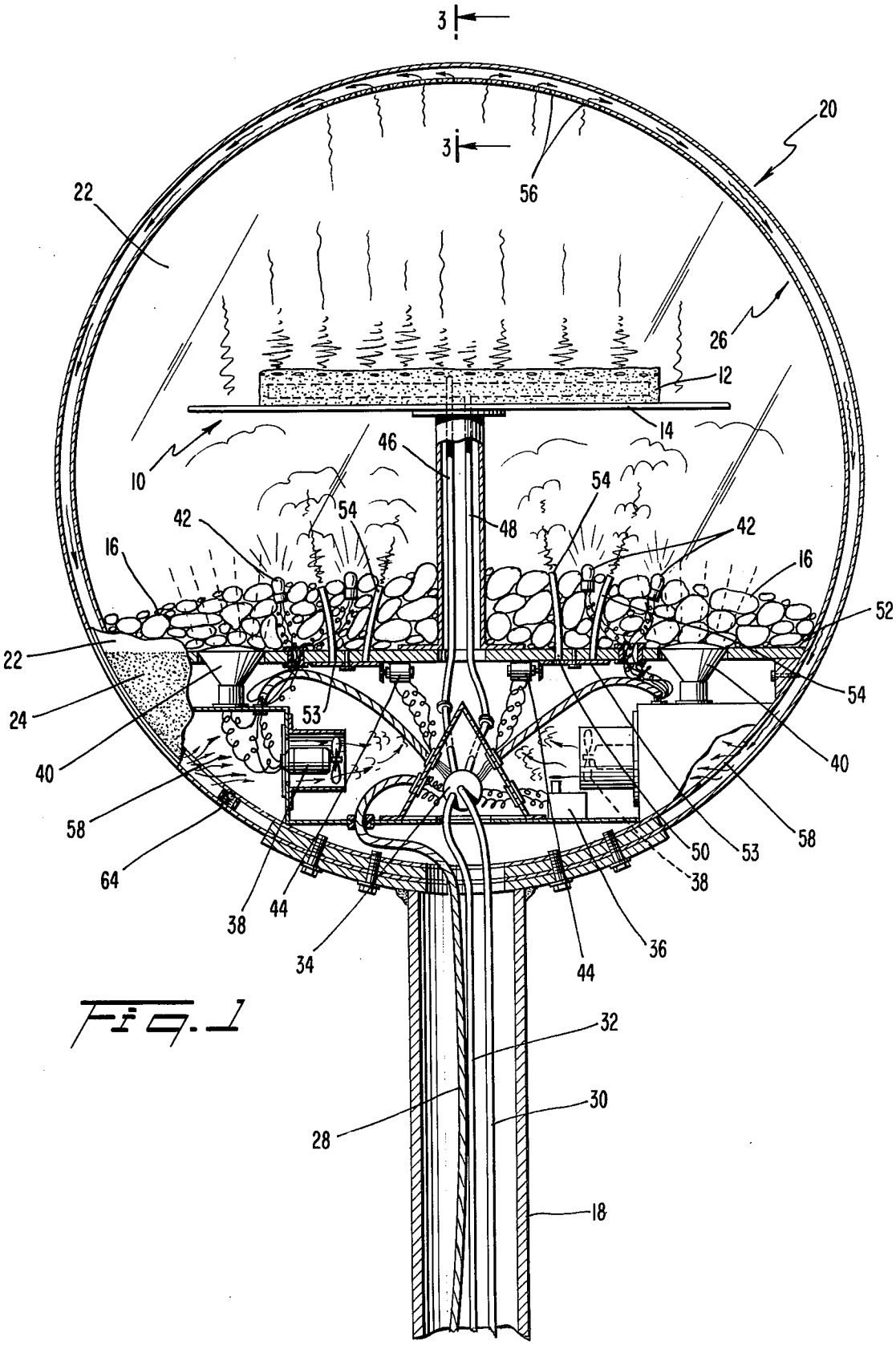
FIG. 1 is a front view of the presently preferred embodiment of my invention.
Figure 2:
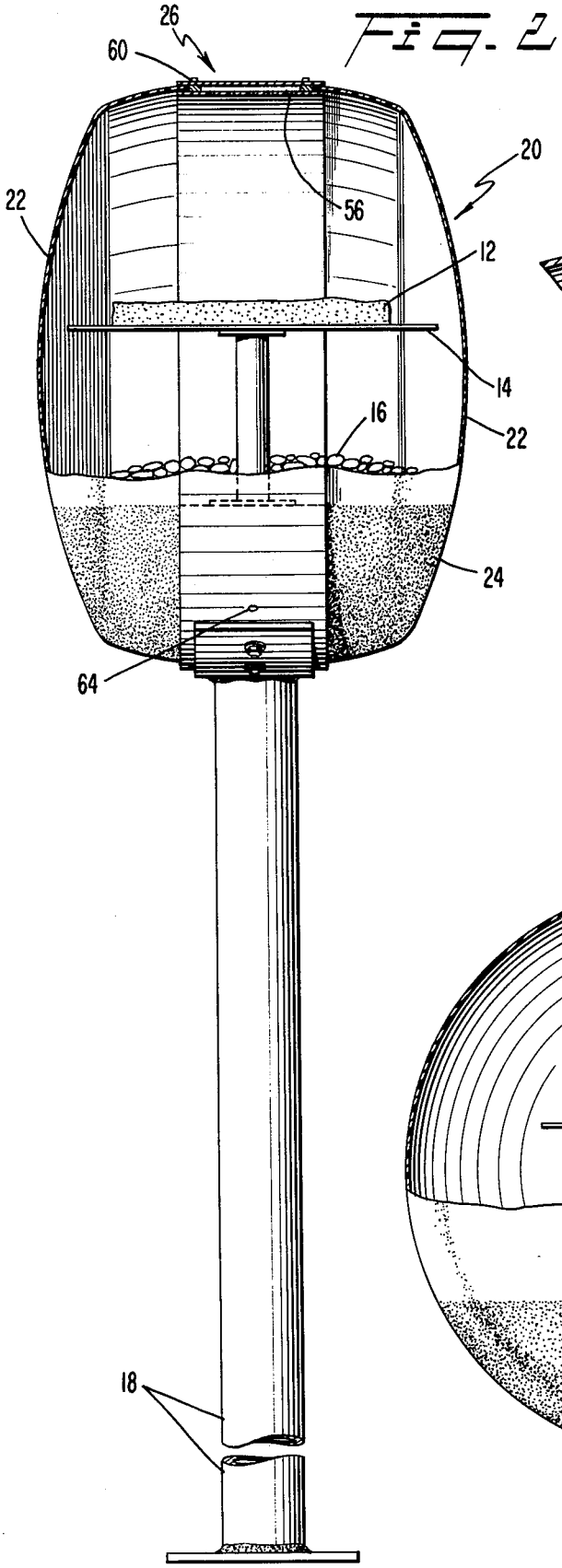
FIG. 2 is a side view of the embodiment shown in FIG. 1.
Figure 3:
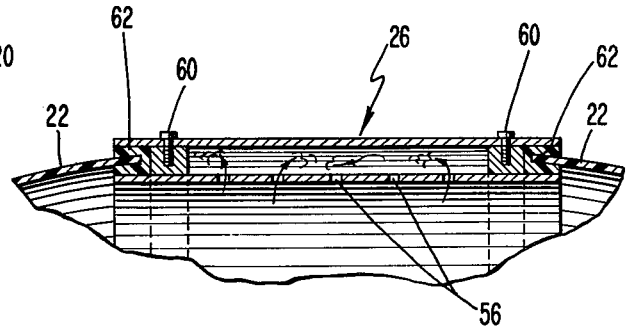
FIG. 3 is an enlarged view along the lines 3-3 in FIG. 1.

The three dimensional action sign shown in FIGS. 1–3 comprises a three dimensional tableau 10 representing meat 12 disposed on a grill 14 over a simulated charcoal fire 16. The tableau 10 is mounted on a hollow pedestal 18 and enclosed in a casing 20 comprising a transparent shield 22 covering the tableau in the direction or directions in which it is intended that it be viewed, an opaque shield 24 covering certain operating components described hereinafter, and a hollow circumferential band 26 for recirculating smoke in a manner also described hereinafter. The simulated meat 12 is preferably made from clay or asbestos since in the presently preferred embodiment it must be capable of withstanding flame, and the transparent shield 22 is preferably made of a heat resistant, easily cleaned synthetic material. The other elements named may be made of any suitable washable and heat resistant material.

Disposed within the hollow pedestal 18 are an electric cord 28, a gas supply line 30, and an oxygen (or air) supply line 32. The electric cord 28 supplies power to a timer 34, a smoke generator 36, two fans 38, two large lights 40, a plurality of small lights 42 and two electric motors 44. The gas supply line 30 and the oxygen supply line 32 joinat a mixing/metering valve contained in the same housing as the timer 34, after which a mixture of gas and oxygen is fed continually to one orifice in the piece of meat 12 via a pilot line 46 and intermittently to a plurality of spaced orifices in the piece of meat 12 via a gas and oxygen supply line 48. When the mixture of gas and oxygen is fed to the spaced orifices via the gas and oxygen supply line 48, it is ignited by a pilot light at the downstream end of the pilot line 46 and leaps upward in spectacular, eye-catching flames. The timer 34 may be set to control the frequency and duration of those flames depending on such factors as the cost of the gas and whether the sign will be viewed mostly be pedestrians or passengers in cars.

The smoke generator 36 may be of any appropriate variety, although it should be selected so that the smoke it generates deposits the minimum possible amount of soot on the transparent shield 22. It may be operated continuously, but because of the smoke recirculation means described hereinafter, it is preferably operated intermittently under the control of the timer 34.

The fans 38 operate continuously to blow smoke from the smoke generator 36 and recirculated smoke from the circumferential band 26 through holes 50 in a support 52 for the charcoal fire 16. To vary the path of the smoke, apertured disks 53 are rotated by the electric motors 44, and when their apertures come into register with the holes 50 in the support 52, puffs of smoke pass through the apertures and the support 52. Although the smoke may be permitted to simply filter its way upwardly through the simulated charcoal fire 16, preferably tubes 54 leading from the holes 50 to the top of the simulated charcoal fire 16 are provided to give the smoke a non-tortuous path.

The large lights 40 are tinted red to give the effect of burning charcoal within the simulated charcoal fire 16, and they are on continuously while the sign is in use. The small lights 42, however, are intended to simulate drops of fat from the piece of meat 12 burning on the simulated charcoal fire 16, and accordingly they are of the type which flicker on briefly and intermittently. The time constants of the small lights 42 should, of course, be different and their lightings uncoordinated in order to further increase the illusion of reality.

The casing 20 contains a plurality of apertures 56 at its top leading (as best seen in FIG. 3) into the hollow circumferential band 26. This band contains further apertures 58 adjacent the intake sides of the fans 38, causing smoke from the interior of the casing 20 to be drawn through the apertures 56, the interior of the hollow band 26, and the apertures 58, after which it is recirculated through the holes 50 and the tubes 54 by the fans 38.

When it is desired to clean the transparent shield 22 or to service the operating components hidden by the opaque shield 24, the shields 22 and 24, which are preferably formed integrally, may be removed by releasing screws 60 shown in FIG. 3. Releasing those screws releases the pressure on resilient rings 62, which permits the shields 22 and 24 to be slid out of an annular groove in that ring which receives the edge of the shields when the sign is in use. Of course, other locking means for the shields may be provided, such as screws or bolts passing directly through clear holes in the edges of the shields and into threaded holes in the hollow band 26.

Since gas and oxygen are constantly being fed into the interior of the sign, means must be provided for venting excess pressure within the sign. While such means could take on many forms, it can conveniently comprise, as illustrated, a spring-loaded ball valve 64 located in the hollow circumferential band 26 beneath the apertures 58. When the pressure in the interior of the sign builds up to the point where it overcomes the spring in the valve 64, the ball moves outwardly, venting the interior of the sign.

Figure 4:
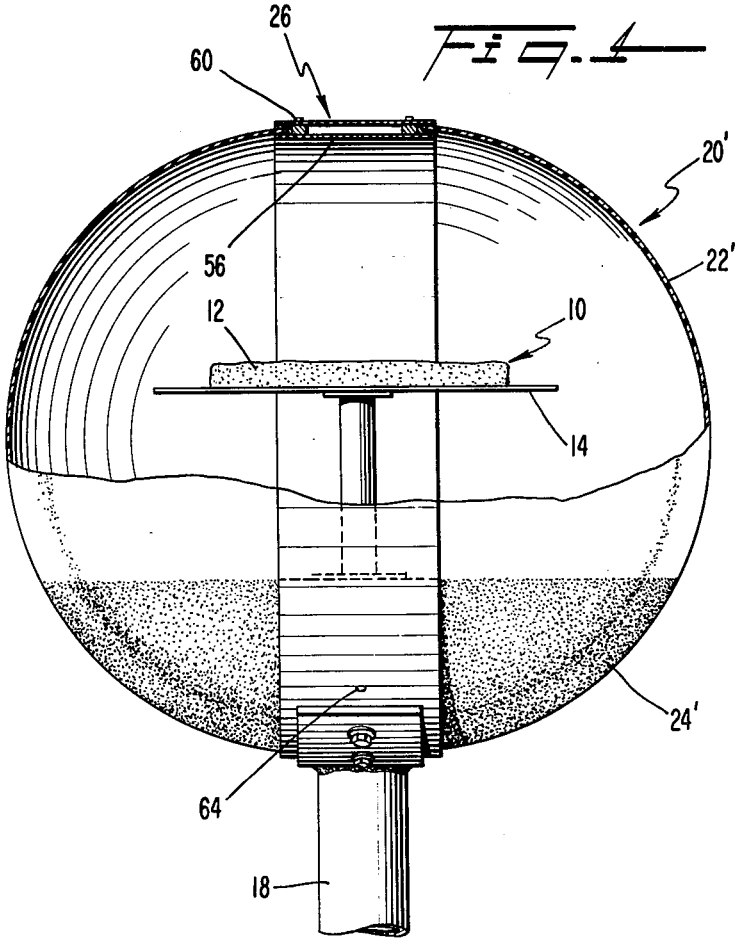
FIG. 4 is a side view of an alternative embodiment.

While the embodiment shown in FIG. 1 through 3 is the presently preferred embodiment, it is of course possible to depart greatly therefrom without departing from the essence of the invention. For instance, the shape of the casing 20 can be varied greatly, as illustrated by FIG. 4, wherein primed numbers are used to identify similar components in the second embodiment. More fundamentally, it is within the contemplation of this invention to replace the gas flame subsystem with an all electrical system, including simulated flames in the form of suitably shaped, pulsating lightbulbs.

What is claimed is:

1. A three-dimensional action sign comprising a three-dimensional tableau of a product to be advertised and independent means for producing at least two separate visible actions in said sign, said independent means comprising means for producing a flame and means for producing smoke, said tableau is of a simulated piece of meat disposed on a grill over a simulated charcoal fire;

said means for producing a flame causes a flame to rise from said piece of meat; and said means for producing smoke causes smoke to rise from simulated charcoal fire.

2. A sign as recited in claim 1 wherein said means for producing a flame produces an intermittent flame.

3. A sign as recited in claim 1 and further comprising lighting means for simulating burning fat in said charcoal fire.

4. A sign as recited in claim 3 wherein said means for simulating burning fat comprise a plurality of light bulbs in said charcoal fire and means for lighting up said light bulbs intermittently and at different times.

5. A sign as recited in claim 1 and further comprising means for recirculating the smoke produced by said means for producing smoke.

6. A sign as recited in claim 5 and further comprising a transparent shield covering said tableau and at least in part defining with said tableau the volume in which the smoke is recirculated.

7. A sign as recited in claim 6 and further comprising means for venting the interior of the sign.

8. A sign as recited in claim 5 wherein said means for producing smoke produces smoke intermittently.

9. A three-dimensional action sign comprising:

(a) a three-dimensional tableau of a product to be advertised, said tableau including a piece of simulated meat disposed on a grill over a simulated charcoal fire;

(b) means for producing a plurality of separate visible actions in said sign, said means including:

(i) means for intermittently producing a flame, said flame appearing to rise from said simulated meat;

(ii) means for intermittently producing smoke, said smoke appearing to rise from said simulated charcoal fire;

(iii) means for recirculating said smoke;

(iv) lighting means for simulating burning fat in said charcoal fire, said lighting means including light bulbs and means for lighting up said light bulbs intermittently and at different times; and (c) a transparent shield covering said tableau, said shield in part defining the volume in which said smoke is recirculated.

* * * * *